US010386168B1

(12) United States Patent
Preiss et al.

(10) Patent No.: US 10,386,168 B1
(45) Date of Patent: Aug. 20, 2019

(54) CONDUCTIVE DETONATING CORD FOR PERFORATING GUN

(71) Applicant: DynaEnergetics GmbH & Co. KG, Troisdorf (DE)

(72) Inventors: Frank Haron Preiss, Bonn (DE); Liam McNelis, Bonn (DE); Thilo Scharf, Letterkenny (IE); Christian Eitschberger, München (DE); Bernhard Scharfenort, Troisdorf (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 16/152,933

(22) Filed: Oct. 5, 2018

Related U.S. Application Data

(60) Provisional application No. 62/683,083, filed on Jun. 11, 2018.

(51) Int. Cl.
*F42C 19/12* (2006.01)
*F42D 1/04* (2006.01)
(Continued)

(52) U.S. Cl.
CPC ..... *F42C 19/12* (2013.01); *E21B 43/1185* (2013.01); *F42B 1/02* (2013.01); *F42D 1/043* (2013.01)

(58) Field of Classification Search
CPC ..... F42C 19/12; E21B 43/1185; F42B 1/02; F42D 1/043
(Continued)

(56) References Cited

U.S. PATENT DOCUMENTS 2,982,210 A 5/1961 Andrew et al.
3,125,024 A * 3/1964 Hicks et al. ..... C06C 5/04 102/275.8
(Continued)

FOREIGN PATENT DOCUMENTS

CN 101435829 A 5/2009
EP 0385614 A2 * 9/1990 ..... C06C 5/06
(Continued)

OTHER PUBLICATIONS

Cao et al., Study on energy output efficiency of mild detonating fuse in cylinder tube structure, Dec. 17, 2015, 11 pgs., https://www.sciencedirect.com/science/article/pii/S0264127515309345.
(Continued)

*Primary Examiner* — John Cooper
(74) *Attorney, Agent, or Firm* — Moyles IP, LLC

(57) ABSTRACT

A detonating cord for using in a perforating gun includes an explosive layer and an electrically conductive layer extending around the explosive layer. The electrically conductive layer is configured to relay a communication signal along a length of the detonating cord. In an embodiment, a protective jacket extends around the electrically conductive layer of the detonating cord. The detonating cord may be assembled in a perforating gun to relay a communication signal from a top connector to a bottom connector of the perforating gun, and to propagate a detonating explosive stimulus along its length to initiate shaped charges of the perforating gun. A plurality of perforating guns, including the detonating cord, may be connected in series, with the detonating cord of a first perforating gun in communication with the detonating cord of a second perforating gun.

9 Claims, 8 Drawing Sheets

(51) Int. Cl.
*F42B 1/02* (2006.01)
*E21B 43/1185* (2006.01)

(58) Field of Classification Search
USPC ..... 102/275.1–275.8, 275.12, 217, 202.11, 102/202.9, 200, 322, 317
See application file for complete search history.

(56) References Cited

U.S. PATENT DOCUMENTS

| | | | | | |
|---|---|---|---|---|---|
| 3,731,626 | A * | 5/1973 | Grayson | C06C 5/04 | 102/275.8 |
| 4,024,817 | A * | 5/1977 | Calder, Jr. | C06C 5/04 | 102/275.7 |
| 4,080,902 | A * | 3/1978 | Goddard | C06B 47/10 | 102/200 |
| 4,132,171 | A | 1/1979 | Pawlak et al. | | |
| 4,220,087 | A | 9/1980 | Posson | | |
| 4,455,941 | A | 6/1984 | Walker et al. | | |
| 4,640,370 | A | 2/1987 | Wetzel | | |
| 4,657,089 | A | 4/1987 | Stout | | |
| 4,762,067 | A | 8/1988 | Barker et al. | | |
| 4,998,478 | A * | 3/1991 | Beck | F42D 1/043 | 102/275.7 |
| 5,001,981 | A | 3/1991 | Shaw | | |
| 5,010,821 | A | 4/1991 | Blain | | |
| 5,223,664 | A | 6/1993 | Rogers | | |
| 5,540,154 | A * | 7/1996 | Wilcox | C06C 5/00 | 102/275.1 |
| 5,837,924 | A * | 11/1998 | Austin | C06C 5/04 | 102/275.8 |
| 6,386,108 | B1 | 5/2002 | Brooks et al. | | |
| 6,467,415 | B2 | 10/2002 | Menzel et al. | | |
| 6,508,176 | B1 | 1/2003 | Badger et al. | | |
| 7,306,038 | B2 | 12/2007 | Challacombe | | |
| 7,350,448 | B2 | 4/2008 | Bell et al. | | |
| 7,640,857 | B2 * | 1/2010 | Kneisl | F42B 3/18 | 102/202.1 |
| 7,661,366 | B2 | 2/2010 | Fuller et al. | | |
| 8,069,789 | B2 | 12/2011 | Hummel et al. | | |
| 8,689,868 | B2 | 4/2014 | Lerche et al. | | |
| 8,884,778 | B2 | 11/2014 | Lerche et al. | | |
| 9,080,433 | B2 | 7/2015 | Lanclos et al. | | |
| 9,494,021 | B2 | 11/2016 | Parks et al. | | |
| 9,523,271 | B2 | 12/2016 | Bonavides et al. | | |
| 9,581,422 | B2 | 2/2017 | Preiss et al. | | |
| 9,605,937 | B2 | 3/2017 | Eitschberger et al. | | |
| 9,689,223 | B2 | 6/2017 | Schacherer et al. | | |
| 2009/0159283 | A1 * | 6/2009 | Fuller | C06C 5/04 | 166/297 |
| 2016/0356132 | A1 | 12/2016 | Burmeister et al. | | |
| 2017/0314373 | A9 | 11/2017 | Bradley et al. | | |

FOREIGN PATENT DOCUMENTS

| | | | | |
|---|---|---|---|---|
| EP | 0482969 | B1 | 8/1996 | |
| WO | WO-0020821 | A1 * | 4/2000 | F42D 1/04 |
| WO | 2015196095 | A1 | 12/2015 | |

OTHER PUBLICATIONS

Hunting Titan Division, Marketing White Paper: H-1® Perforating Gun System, Jan. 2017, 5 pgs., http://www.hunting-intl.com/media/2674690/White%20Paper%20-%20H-1%20Perforating%20Gun%20Systems_January%202017.pdf.

* cited by examiner

CONDUCTIVE DETONATING CORD FOR PERFORATING GUN

CROSS-REFERENCE TO RELATED APPLICATIONS

This application claims the benefit of U.S. Provisional Application No. 62/683,083 filed Jun. 11, 2018, which is incorporated herein by reference in its entirety.

BACKGROUND OF THE DISCLOSURE

Perforating gun assemblies are used in many oilfield or gas well completions. In particular, the assemblies are used to generate holes in steel casing pipe/tubing and/or cement lining in a wellbore to gain access to the oil and/or gas deposit formation. In order to maximize extraction of the oil/gas deposits, various perforating gun systems are employed. These assemblies are usually elongated and frequently cylindrical, and include a detonating cord arranged within the interior of the assembly and connected to shaped charge perforators (or shaped charges) disposed therein.

The type of perforating gun assembly employed may depend on various factors, such as the conditions in the formation or restrictions in the wellbore. For instance, a hollow-carrier perforating gun system having a tube for carrying the shaped charges may be selected to help protect the shaped charges from wellbore fluids and pressure (the wellbore environment). An alternative perforating gun system often used is an exposed or encapsulated perforating gun system. This system may allow for the delivery of larger sized shaped charges than those of the same outer diameter sized hollow-carrier gun system. The exposed perforating gun system typically includes a carrier strip upon which shaped charges are mounted. Because these shaped charges are not contained within a hollow tube, as those of a hollow-carrier perforating gun system, the shaped charges are individually capsuled.

Typically, shaped charges are configured to focus ballistic energy onto a target to initiate production flow. Shaped charge design selection is also used to predict/simulate the flow of the oil and/or gas from the formation. The configuration of shaped charges may include conical or round aspects having an initiation point formed in a metal case, which contains an explosive material, with or without a liner therein, and that produces a perforating jet upon initiation. It should be recognized that the case or housing of the shaped charge is distinguished from the casing of the wellbore, which is placed in the wellbore after the drilling process and may be cemented in place in order to stabilize the borehole and isolate formation intervals prior to perforating the surrounding formations.

Current perforating gun systems are mechanically connected via tandem sub assemblies. For wireline conveyance and selective perforating, the perforating gun is also electrically connected to an adjacent perforating gun by a bulkhead, which is included in the tandem sub. The bulkhead typically provides pressure isolation and includes an electric feedthrough pin. Each perforating gun may include multiple wires, such as feed-through or grounding wires as well as a detonating cord, which typically run parallel to each other through the length of the perforating gun. The feed-through wire is typically configured to electrically connect a perforating gun to an adjacent perforating gun, and the detonating cord is typically configured to initiate shaped charges disposed in each perforating gun. Further description of such perforating guns may be found in commonly-assigned U.S. Pat. Nos. 9,605,937, 9,581,422, 9,494,021, and 9,702,680, each of which are incorporated herein by reference in their entireties. Other perforating gun systems may utilize charge tubes/charge cartridges as a reduction option for the feed-through wire or separate electronic switches in the gun (sometimes externally connected to the detonator) that allows you to switch between different gun assemblies. Such perforating guns are described in U.S. Pat. Nos. 8,689,868, 8,884,778, 9,080,433, and 9,689,223. The use of multiple wires often requires additional assembly steps and time, which may result in increased assembly costs.

In view of the disadvantages associated with currently available perforating gun assemblies there is a need for a device that reduces assembly steps and time and improves safety and reliability of perforating gun assemblies. There is a further need for a perforating gun having simplified wiring, which may reduce human error in assembling perforating gun systems. Further, this results in a need for a detonating cord that relays/transfers electrical signals along a length of a perforating gun, without requiring additional wires, and without the need to isolate conductive elements.

BRIEF DESCRIPTION OF THE EXEMPLARY EMBODIMENTS

According to an aspect, the present embodiments may be associated with a detonating cord for using in a perforating gun. The detonating cord includes an explosive layer and an electrically non-conductive layer. An insulating layer extends along a length of the detonating cord, between the explosive layer and the electrically conductive layer. The electrically conductive layer may include a plurality of conductive threads and is configured to relay/transfer a communication signal along the length of the detonating cord. In an embodiment, a jacket/outer jacket layer extends around the electrically conductive layer of the detonating cord. The conductive detonating cord may further include a plurality of non-conductive threads spun/wrapped around the explosive layer. The jacket may help protect any of the inner layers (such as the explosive, electrically conductive and insulating layers) from damage due to friction by external forces.

Additional embodiments of the disclosure may be associated with a perforating gun. The perforating gun includes a detonating cord configured substantially as described hereinabove, and is energetically and electrically coupled to a detonator. The detonating cord includes an explosive layer, an electrically conductive layer and an insulating layer in between the explosive layer and the electrically conductive layer. The detonator further includes a plurality of non-conductive threads around the explosive layer, and a jacket that covers the electrically conductive layer. The non-conductive threads adds strength and flexibility to the detonating cord, while the jacket helps to protect the layers of the detonating cord from damage due to friction by external forces. According to an aspect, the detonating cord spans the length of the perforating gun and connects to at least one shaped charge positioned in the perforating gun. The detonating cord is configured to relay/transfer a communication signal along a length of the detonating cord, and to propagate a detonating explosive stimulus along its length and to the shaped charge.

Further embodiments of the disclosure are associated with a method of electrically connecting a plurality of perforating guns that each include the aforementioned detonating cord. The perforating guns may be connected in series, with the detonating cord of a first perforating gun in electrical communication with the detonating cord of a second perforating gun. This arrangement reduces the number of wires within each perforating gun, while facilitating the connection to adjacent perforating guns via a bulkhead connection or a booster kit with electric contact function.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
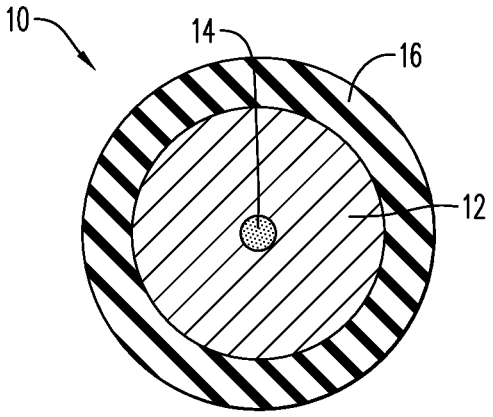
FIG. 1A is a cross-sectional view of a detonating cord/electrically conductive detonating cord, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Figure 1B:
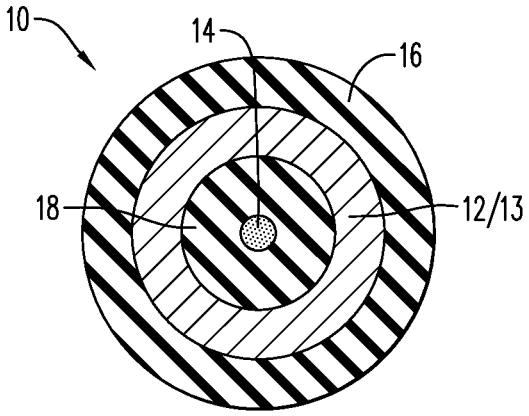
FIG. 1B is a cross-sectional view of a detonating cord/electrically conductive detonating cord including an insulating layer, according to an embodiment.

For purposes of illustrating features of the embodiments, reference be made to various figures. FIGS. 1A-1B illustrate various features of a detonating cord for use in a perforating gun/perforating gun assemblies. As will be discussed in connection with the individual illustrated embodiments, the detonator generally is connected electrically, which requires the transmission of a communication signal (i.e., electric current) through a lead wire or along the length of the conductive detonating cord. The electric current may be used to transmit telemetry signals, charge down-hole capacitors, initiate detonators in perforating gun assemblies, and communicate to other devices such as an ignitor a for bridge plug setting tool which are positioned below the perforating gun assembly. The electrically conductive materials of the detonating cord helps to reduce the number of required wires in perforating gun assemblies, and helps to facilitate the electrical connection between a plurality of perforating guns.

Embodiments of the disclosure may be associated with a detonating cord/electrically conductive detonating cord 10. The detonating cord 10 may be a flexible structure that allows the detonating cord 10 to be bent or wrapped around structures. According to an aspect, the detonating cord 10 may include a protective structure or sheath 16 that prevents the flow of an extraneous or stray electric current through the explosive layer 14 within the detonating cord 10.

According to an aspect, and as illustrated in FIGS. 1A-2B, the detonating cord 10 includes an explosive layer/linear explosive layer 14. The explosive layer 14 may include an insensitive secondary explosive (i.e., an explosive that is less sensitive to electrostatic discharge (ESD), friction and impact energy within the detonating cord, as compared to a primary explosive). According to an aspect, the explosive layer 14 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), Hexanitrostilbene (HNS), 2,6-Bis (picrylamino)-3,5-dinitropyridine (PYX), and nonanitroterphenyl (NONA). The type of material selected to form the explosive layer 14 may be based at least in part on the temperature exposure, radial output and detonation velocity of the material/explosive. In an embodiment, the explosive layer includes a mixture of explosive materials, such as, HNS and NONA. As would be understood by one of ordinary skill in the art, the explosive layer 14 may include compressed explosive materials or compressed explosive powder. The explosive layer 14 may include constituents to improve the flowability of the explosive powder during the manufacturing process. Such constituents may include various dry lubricants, such as, plasticizers, graphite, and wax.

The detonating cord 10 further includes an electrically conductive layer 12. The electrically conductive layer 12 is configured to relay/transfer a communication signal along the length L of the detonating cord 10. The communication signal may be a telemetry signal. According to an aspect, the communication signal includes at least one of a signal to, check and count for detonators in a perforating gun string assembly, address and switch to certain detonators, charge capacitors and to send a signal to initiate a detonator communicably connected to the detonating cord 10. The integration of the electrically conductive layer 12 in the detonating cord 10 helps to omit the electric feed-through wires presently being used.

According to an aspect, the electrically conductive layer 12 extends around the explosive layer 14 in a spaced apart configuration. As will be described in further detail hereinbelow, an insulating layer 18 may be sandwiched between the explosive layer 12 and the electrically conductive layer 12. The electrically conductive layer 14 of the detonating cord 10 may include a plurality of electrically conductive threads/fibers spun or wrapped around the insulating layer 18, or an electrically conductive sheath/pre-formed electrically conductive sheath 13 in a covering relationship with the insulating layer 18. According to an aspect, the electrically conductive sheath 13 comprises layers of electrically conductive woven threads/fibers that are pre-formed into a desired shape that allows the electrically conductive sheath to be easily and efficiently placed or arranged over the insulating layer 18. The layers of electrically conductive woven threads may be configured in a type of crisscross or overlapping pattern in order to minimize the effective distance the electrical signal must travel when it traverses through the detonating cord 10. This arrangement of the threads helps to reduce the electrical resistance (Ohm/ft or Ohm/m) of the detonating cord 10. The electrically conductive threads and the electrically conductive woven threads may include metal fibers or may be coated with a metal, each metal fiber or metal coating having a defined resistance value (Ohm/ft or Ohm/m). It is contemplated that longer gun strings (i.e., more perforating guns in a single string) may be formed using perforating guns that including the electrically conductive detonating cord 10.

Figure 2A:
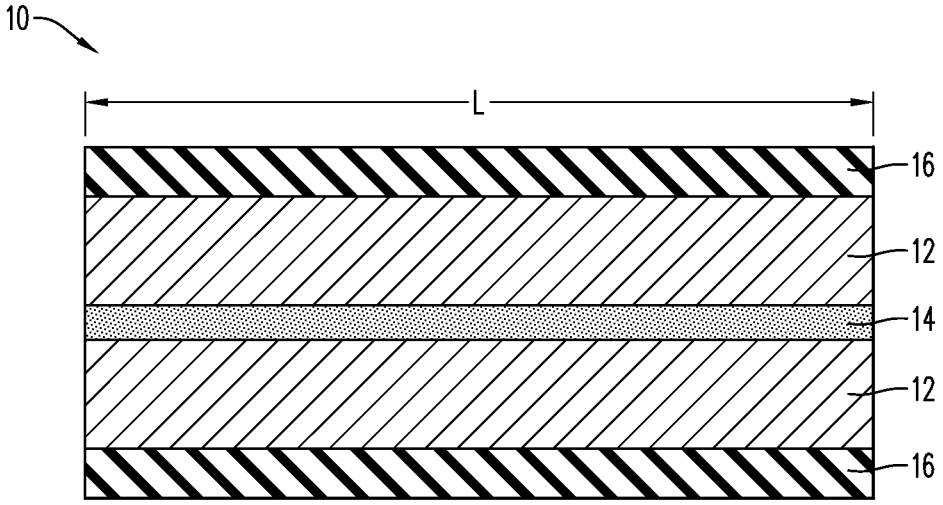
FIG. 2A is a side, cross-sectional view of the detonating cord of FIG. 1A.
Figure 2B:
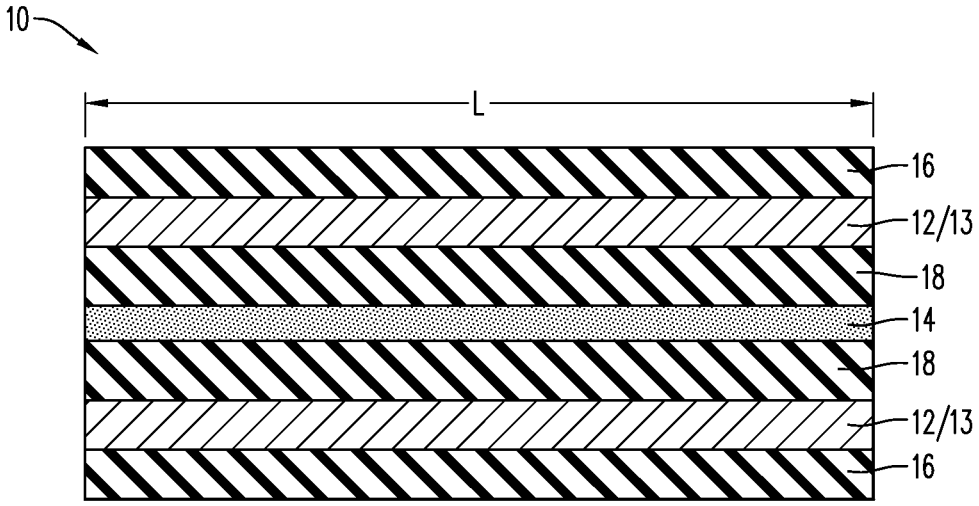
FIG. 2B is a side, cross-sectional view of the detonating cord of FIG. 1B.

FIG. 1B and FIG. 2B illustrate the detonating cord 10 including an insulating layer 18. The insulating layer 18 is disposed/positioned between the explosive layer 14 and the electrically conductive layer 12. As illustrated in FIG. 2B, for example, the insulating layer 18 may extend along the length L of the detonating cord 10. According to an embodiment (not shown), the insulating layer 18 may only extend along a portion of the length L of the detonating cord, where the explosive layer 14 would potentially be adjacent the electrically conductive layer 12. The insulating layer may be formed of any nonconductive material. According to an aspect, the insulating layer 18 may include at least one of a plurality of non-conductive aramid threads, a polymer, such as fluorethylenpropylene (FEP), polyamide (PA), polyethylenterephthalate (PET), or polyvinylidenfluoride (PVDF), and a coloring additive.

The detonating cord 10 may include a layer of material along its external surface to impart additional strength and protection to the structure of the detonating cord 10. FIGS. 1A-2B each illustrate a jacket/outer protective jacket 16 externally positioned on the detonating cord 10. According to an aspect, the jacket 16 is formed of at least one layer of woven threads. The jacket 16 may be formed from a nonconductive polymer material, such as FEP, PA, PET, and PVDF. According to an aspect, the jacket 16 is formed of at least one layer of non-conductive woven threads and covered by a sheath formed from a plastic, composite or lead.

As illustrated in FIGS. 1A and 1B, the jacket 16 extends around/surrounds/encases the electrically conductive layer 12 or the electrically conductive sheath 13, the insulating layer 18, and the explosive layer 14. The jacket 16 extends along the length L of the detonating cord 10, and may be impervious to at least one of sour gas ($H_2S$), water, drilling fluid, and electrical current.

Figure 3A:
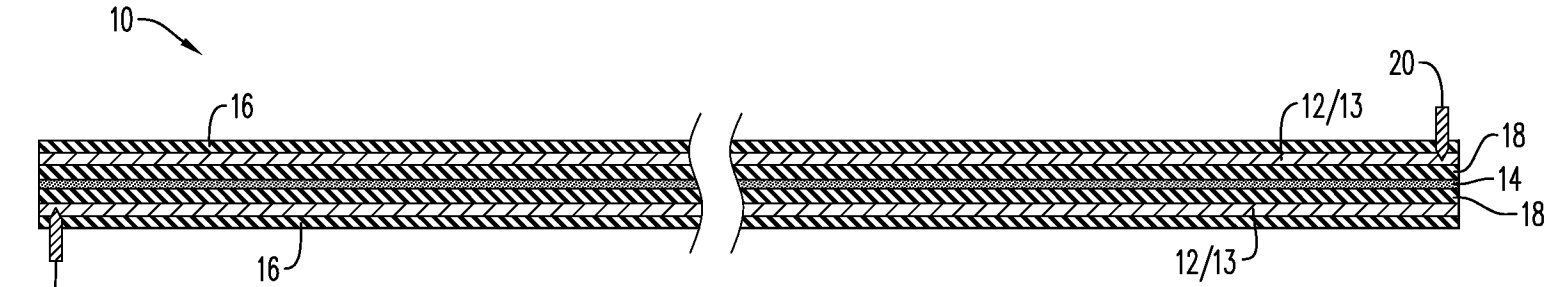
FIG. 3A is a side, partial cross-sectional view of a detonating cord/electrically conductive detonating cord, illustrating contacts embedded therein, according to an embodiment.
Figure 3B:
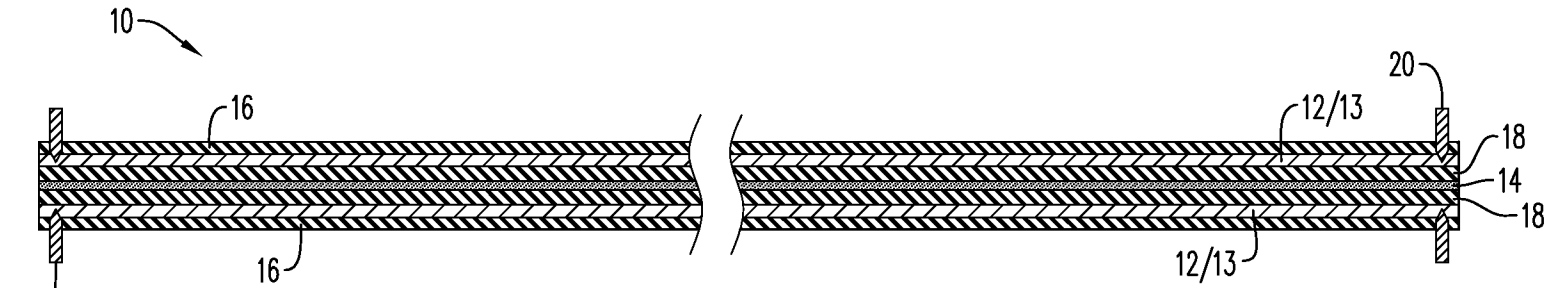
FIG. 3B is a side, partial cross-sectional view of a detonating cord/electrically conductive detonating cord illustrating contacts extending around a portion of the detonating cord, according to an embodiment.

According to an aspect, electric pulses, varying or alternating current or constant/direct current may be induced into or retrieved from the electrically conductive layer 12/electrically conductive sheath 13 of the detonating cord 10. FIG. 3A and FIG. 3B illustrate the detonating cord 10 including contacts 20. According to an aspect, the contacts 20 may include a metal, such as aluminum, brass, copper, stainless steel or galvanized steel (including zinc).

The contacts 20 are configured to input a communication signal at a first end/contact portion of the detonating cord 10 and output the communication signal at a second end/contact portion of the detonating cord 10. In order to facilitate the communication of the communication signal, the contacts 20 may at least partially be embedded into the detonating cord 10. The contacts 20 may be coupled to or otherwise secured to the detonating cord 10. According to an aspect, the contacts 20 are crimped onto the detonating cord 10, in such a way that the contacts 20 pierce through the protective outer jacket 16 of the detonating cord 10 to engage the electrically conductive layer 12 or the conductive sheath 13.

Figure 4A:
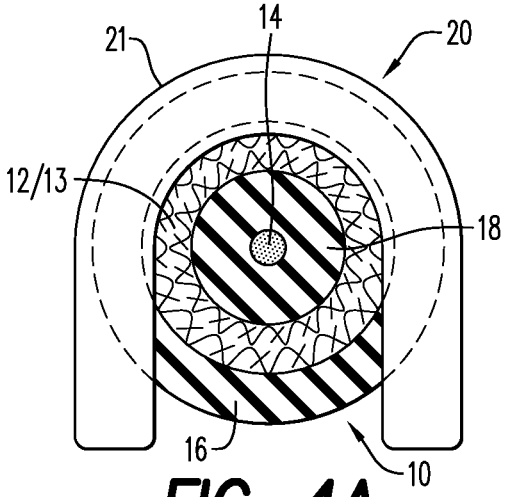
FIG. 4A is a cross-sectional view of a split sleeve contact partially extending around and partially embedded in a detonating cord/electrically conductive detonating cord, according to an embodiment.

FIG. 4A illustrates the contacts 20 extending around and cutting into a portion of the jacket 16. The contact may include a split sleeve 21, that engages and contacts with at least a portion of the electrically conductive layer 12. The split sleeve 21 includes a longitudinal split, which allows the split sleeve 21 to be temporarily bent or deformed to be placed on or be positioned over the detonating cord 10. The split sleeve 21 may include a plurality of retention features (not shown) that pierce through the jacket 16 and engages with the electrically conductive threads 12.

Figure 4B:
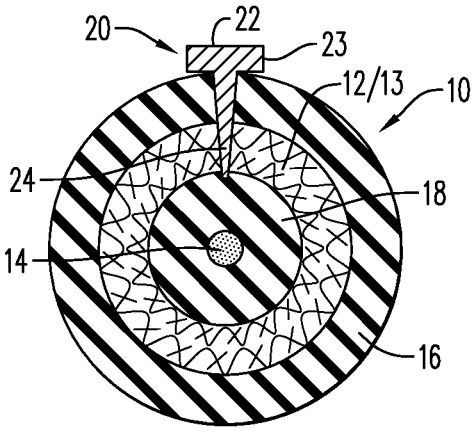
FIG. 4B is a cross-sectional view of a contact including a conductive pin partially embedded in a detonating cord/electrically conductive detonating cord, according to an embodiment.
Figure 4C:
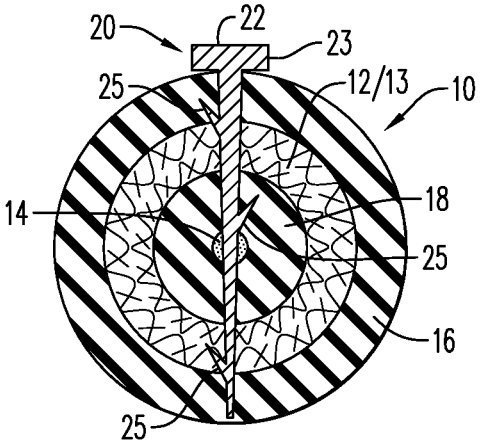
FIG. 4C is a cross-sectional view of a contact including a conductive pin having retention mechanisms and partially embedded in a detonating cord/electrically conductive detonating cord, according to an embodiment.
Figure 5:
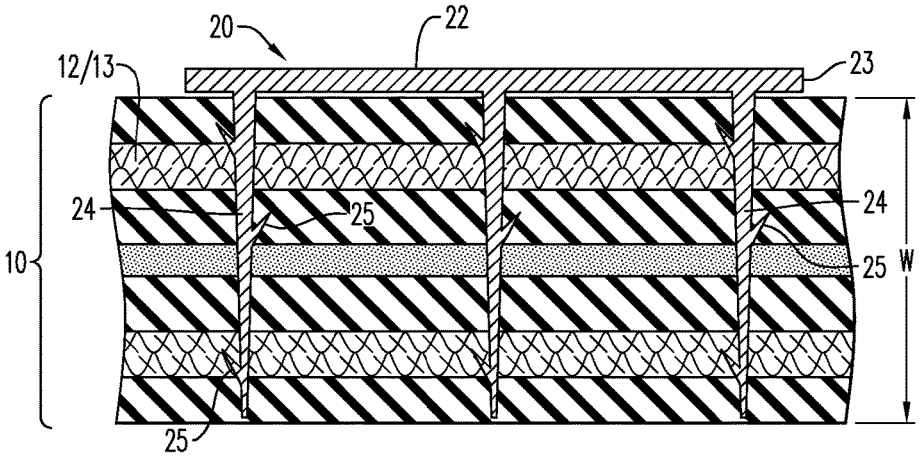
FIG. 5 is a side, cross-sectional view of the contact of FIG. 4C, illustrating a plurality of lower portions and retention mechanisms.

FIGS. 4B and 4C illustrate the contacts 20 including a conductive pin 22. The conductive pin 22 includes an upper portion 23, and at least one lower portion 24 extending from the upper portion 23. The lower portion 24 is configured for engaging the electrically conductive layer 12 of the detonating cord, while the upper portion 23 facilitates the proper placement/arrangement of the conductive pin 22 and, if necessary, facilitates the removal of the conductive pin 22 from the detonating cord 10. As illustrated, for instance, in FIG. 5, the lower portion 24 may be sized to extend across (partially or fully) a width W of the detonating cord 10. According to an aspect and as illustrated in FIG. 4C and FIG. 5, the lower portion 24 may include a plurality of retention mechanisms 25. The retention mechanisms 25 may be shaped as spikes or as barbs that engage with at least one of the layers of the detonating cord 10. FIG. 5 illustrates the retention mechanisms 25 pierced through the entire width W of the detonating cord 10.

While the arrangements of the layers of the detonating cord 10 have been illustrated in FIGS. 1A-5 and described in detail hereinabove, it is to be understood that the layers may be arranged in different orders based on the application in which the detonating cord 10 will be used. For example, the electrically conductive layer 12 may be the innermost layer, with the insulating layer 18 adjacent the conductive layer, and the explosive layer 14 extending around the insulating layer 18 (not shown). The jacket 16 extends around the layers and helps protect the detonating cord 10 from damage and exposure to undesired friction and liquids.

Figure 6:
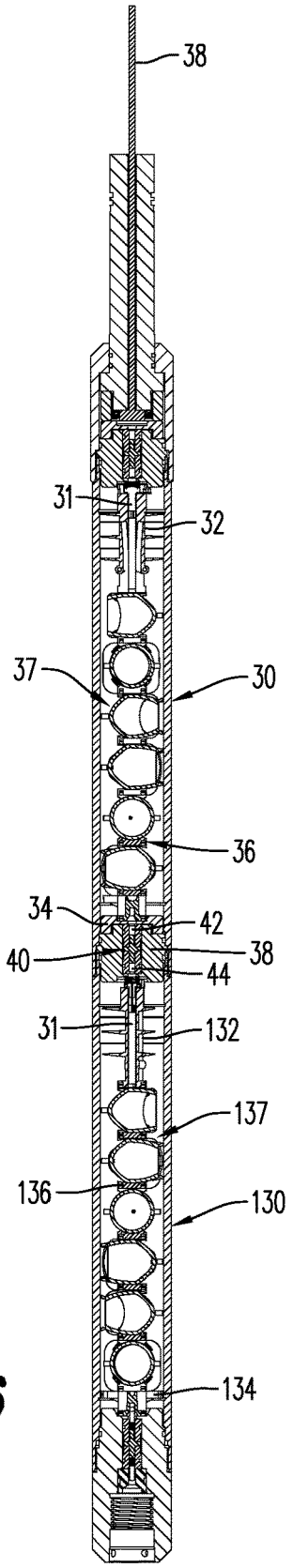
FIG. 6 is a side, cross-sectional view of a perforating gun including a detonating cord/electrically conductive detonating cord, according to an embodiment.

Further embodiments of the disclosure are associated with a perforating gun 30/adjacent perforating guns 130, as illustrated in FIGS. 6A-8. FIGS. 6, 6A and 6B and FIG. 7 illustrate the perforating gun 30/130 including a top connector 32, a bottom connector 34, and a charge holder 36. As illustrated in FIG. 6, multiple charge holders 36 may extend between the top and bottom connectors 32, 34. Each charge holder 36 is configured for holding a shaped charge 37. The shaped charges 37 may be of any size or of any general shape, such as conical or rectangular. While the shaped charges 37 illustrated are open/un-encapsulated shaped charges, it is contemplated that the charge holders 36 may include encapsulated shaped charges.

Figure 6A:
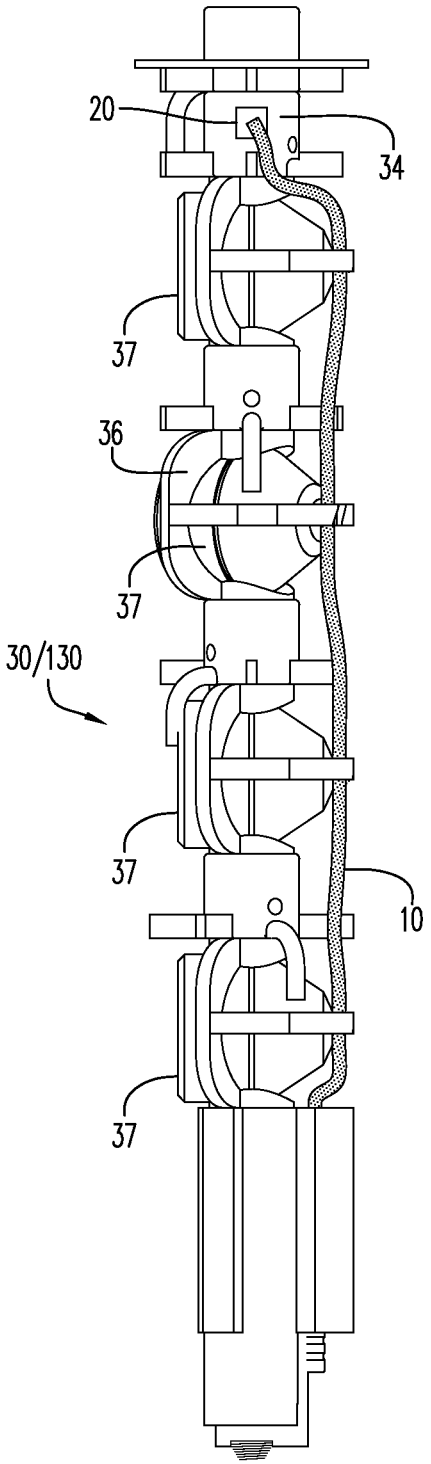
FIG. 6A is a side, perspective view of the perforating gun of FIG. 6, illustrating the arrangement of the electrically conductive detonating cord.
Figure 8:
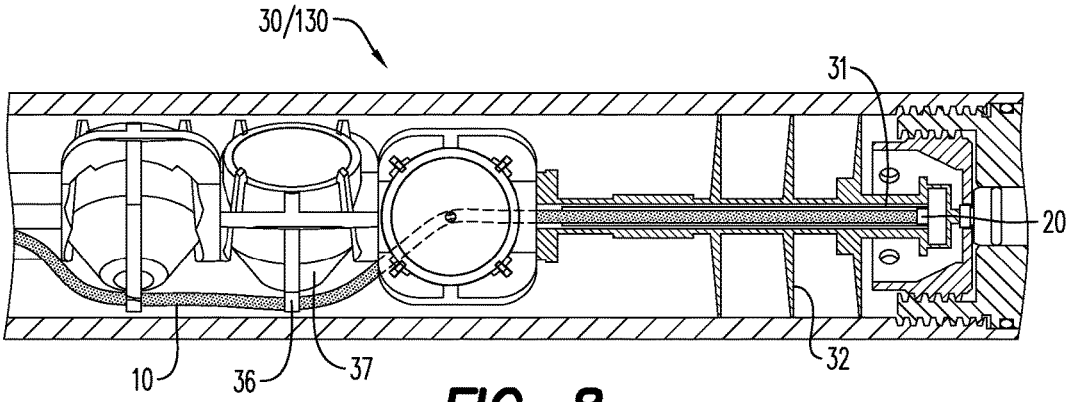
FIG. 8 is a side, partial cross-sectional view of the perforating gun of FIG. 6, illustrating a detonator housed in a top connector, and a detonating cord extending from the top connected to a charge holder.

As illustrated in FIGS. 6A and 8, the perforating gun 30/130 includes a detonating cord 10. The detonating cord 10 may extend from the top connector 32 to the bottom connector 34, and may be connected to each of the shaped charges 37 positioned in the perforating gun 30. The detonating cord 10 is configured to initiate the shaped charge 37 disposed in each charge holder 36. For purposes of convenience, and not limitation, the general characteristics of the detonating cord 10 described hereinabove with respect to FIGS. 1A-5, are not repeated here.

The detonating cord 10 electrically connects the top connector 32 to the bottom connector 34, which in return connects to an adjacent perforating gun 130 (FIGS. 6, 6A-6B and FIG. 7). In this configuration, the detonating cord 10 electrically connects contact points/areas in the top connector 32 of the perforating gun 30 to a corresponding contact point/area in the bottom connector 134 of an adjacent perforating gun 130. According to an aspect, the top connector 132 of the adjacent perforating gun 130 may be electrically connected to a corresponding bottom connector of another adjacent perforating gun.

Figure 6B:
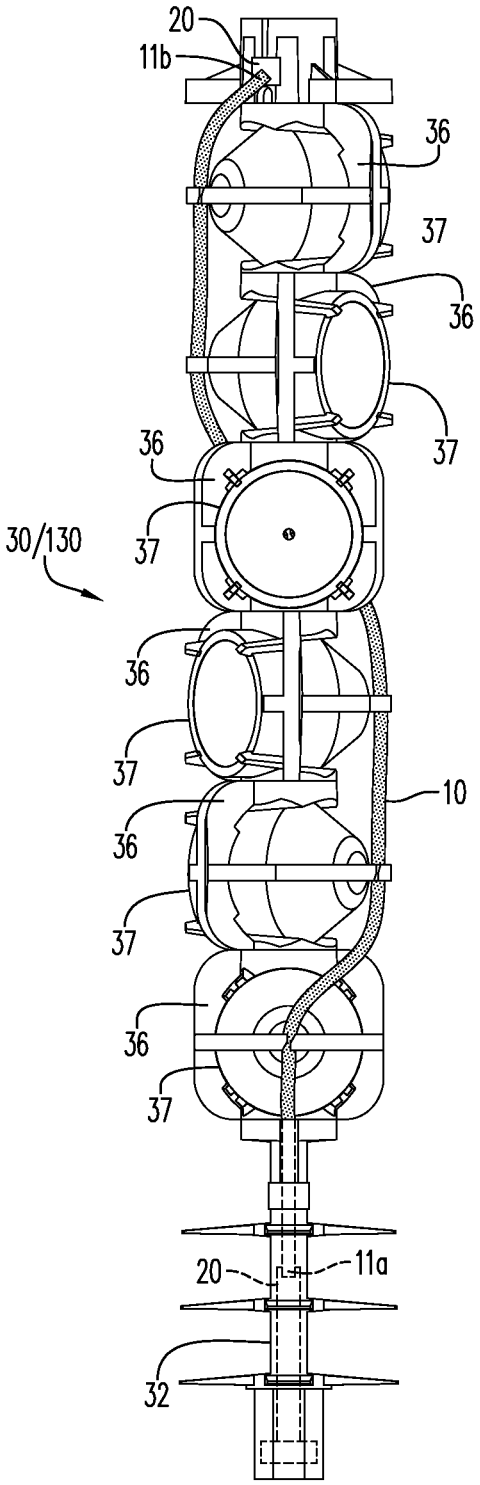
FIG. 6B is a side, perspective view of the perforating gun of FIG. 6, illustrating the arrangement of the components of the perforating gun.
Figure 7:
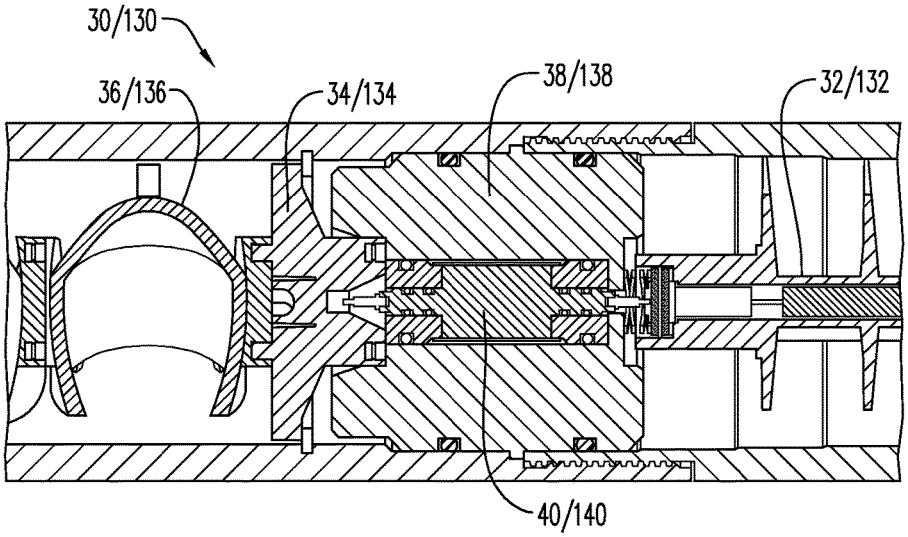
FIG. 7 is a side, cross-sectional view of a portion of the perforating gun of FIG. 6.

The perforating gun 30/adjacent perforating gun 130 may include one or more contacts 20, configured substantially as described hereinabove and illustrated in FIGS. 3A-5. Thus, for purposes of convenience and not limitation, the features and structure of the contacts 20 described above and illustrated in FIGS. 3A-5 are not repeated here. According to an aspect, the contacts may include a first contact and a second contact. The first contact may be positioned or otherwise disposed in the top connector 32, while the second contact may be positioned or otherwise disposed in the bottom connector 34 (FIGS. 6A-6B and 8).

The perforating gun 30 may further include a tandem seal adapter 38 configured for housing a bulkhead assembly 40. The bulkhead assembly 40 may include a first end/first electrical contact end 42 and a second end/second electrical contact end 44. According to an aspect, the first end 42 is electrically connected to the bottom connector 34 of the perforating gun 30, and the second end 44 is electrically connected to a top connector 132 of an adjacent (or downstream) perforating gun 130. According to an aspect, a communication signal is communicated through the bulkhead assembly of the tandem seal adapter 38 to the adjacent perforating gun 130, via at least the detonating cord 10 including the electrically conductive layer 12.

FIG. 8 illustrates a detonator 31 arranged in the top connector 32. The detonator 31 is energetically and electrically coupled to the detonating cord 10 through the contacts 20. As described in detail hereinabove, the contacts 20 input the communication signal at a first end/contact portion 11*a* of the detonating cord 10 and output the communication signal at a second end/contact portion 11*b* of the detonating cord 10. The communication signal is at least one of a telemetry signal, a signal to check and count for detonators in the gun string assembly, address and switch to certain detonators, to charge capacitors, and a signal to initiate the detonator 31.

According to an aspect, the detonator 31 is one of an RF-safe electronic detonator, a resistorized/electric detonator, or a detonator using a fire set, an EFI, an EBW, a semiconductor bridge and/or an igniter. The detonator 31 may include a line-in portion, and a line-out portion and a grounding contact. The line-in portion of the detonator 31 may be connected to the second end 44 of the bulkhead assembly 40, which may be electrically connected to the top connector 132 of the adjacent perforating gun 130. The line-out portion of the detonator 31 may connect to the first end 42 of an adjacent bulkhead assembly 140 that is electrically connected to a bottom connector 134 of the adjacent perforating gun 130. According to an aspect, the adjacent perforating gun 130 may be a bottommost perforating gun, and the communication signal may be an electric signal that is relayed/transferred to the bottommost perforating gun from the top perforating gun 30.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A detonating cord for use with a perforating gun comprising:

an explosive layer;

an electrically conductive layer extending around the explosive layer;

a jacket extending around the electrically conductive layer, wherein the explosive layer, the electrically conductive layer and the jacket each extends along a length of the detonating cord, and the electrically conductive layer is configured to transfer a communication signal;

a first contact portion configured for receiving the communication signal;

a second contact portion spaced apart from the first contact portion, and configured for outputting the communication signal; and one or more contacts configured for being secured to a least one of the first contact portion and the second contact portion, the contacts comprising at least one of a split sleeve and a conductive pin, wherein the split sleeve and the conductive pin are configured to pierce the jacket to engage the electrically conductive layer.

2. The detonating cord of claim 1, further comprising:

an insulating layer extending along the length of the detonating cord between the explosive layer and the electrically conductive layer.

3. The detonating cord of claim 1, wherein one of more contacts comprise the conductive pin, and the conductive pin comprises:

an upper portion; and at least one lower portion extending from the upper portion, wherein the lower portion is configured for engaging the electrically conductive layer.

4. The detonating cord of claim 3, wherein the lower portion comprises a plurality of retention mechanisms configured for securing the conductive pin within at least a portion of the detonating cord.

5. The detonating cord of claim 3, wherein the lower portion extends across a width of the detonating cord.

6. The detonating cord of claim 1, wherein the electrically conductive layer comprises one of an electrically conductive sheath and a plurality of electrically conductive threads.

7. The detonating cord of claim 6, wherein the electrically conductive sheath comprises a layer of electrically conductive woven threads comprising at least one of a plurality of metal fibers and a plurality of metal coated fibers.

8. The detonating cord of claim 6, wherein the electrically conductive sheath comprises a layer of electrically conductive woven threads comprising at least one of a plurality of metal fibers and a plurality of metal coated fibers.

9. The detonating cord of claim 1, wherein the contacts secured to the first contact portion are configured to input the communication signal to the detonating cord; and the contacts secured to the second contact portion are configured to output the communication signal from the detonating cord.

* * * * *